United States Patent [19]

Verberkmoes

[11] 4,174,086

[45] Nov. 13, 1979

[54] FOLDING TRAY RAIL BRACKET

[75] Inventor: John A. Verberkmoes, Grand Haven, Mich.

[73] Assignee: Bastian Blessing Company, Inc., Phoenix, Ari.

[21] Appl. No.: 876,648

[22] Filed: Feb. 10, 1978

[51] Int. Cl.[2] ..... A47G 29/02

[52] U.S. Cl. ..... 248/242; 248/291

[58] Field of Search ..... 248/240, 240.4, 241, 248/242, 291, 293; 297/335, 336, 417; 312/140.4, 283

[56] References Cited

U.S. PATENT DOCUMENTS

| | | | |
|---|---|---|---|
| 439,731 | 11/1890 | Klineline | 248/240.4 X |
| 1,596,075 | 8/1926 | Buswell | 248/293 X |
| 1,892,687 | 1/1933 | Teufel | 248/293 X |
| 4,037,896 | 7/1977 | Kennedy et al. | 248/293 X |

FOREIGN PATENT DOCUMENTS

| | | | |
|---|---|---|---|
| 224092 | 11/1924 | United Kingdom | 248/242 |

*Primary Examiner*—Lawrence J. Staab
*Attorney, Agent, or Firm*—Watson D. Harbaugh

[57] ABSTRACT

The present invention relates to a food service tray slide rail drop support bracket where an accidental or intentional vertical movement of the front edge of the rail will not induce a folding or dropping of the rail below a horizontal tray-supporting position. The rear edge is lifted for lowering the front edge.

3 Claims, 7 Drawing Figures

FIG. 5
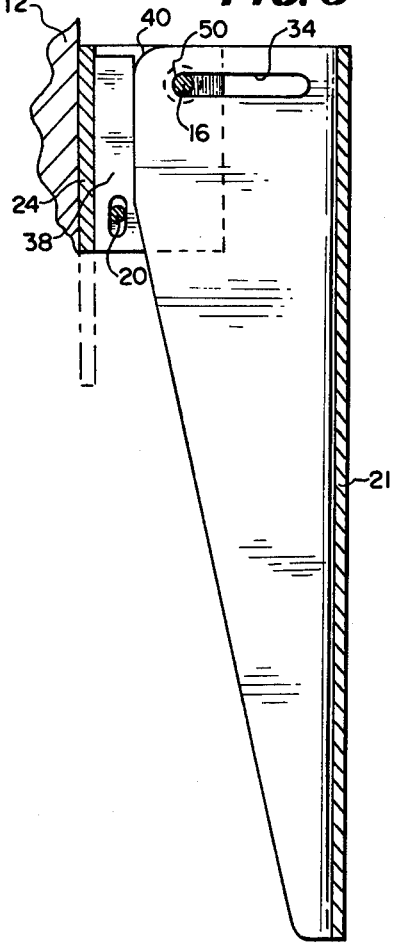
FIG. 6
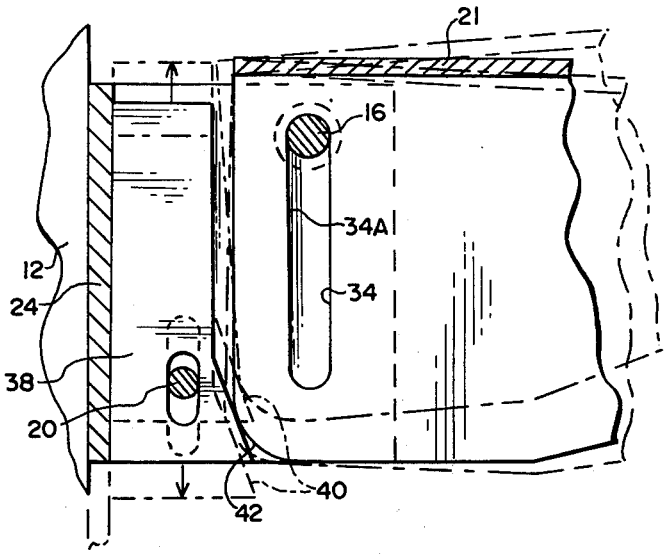
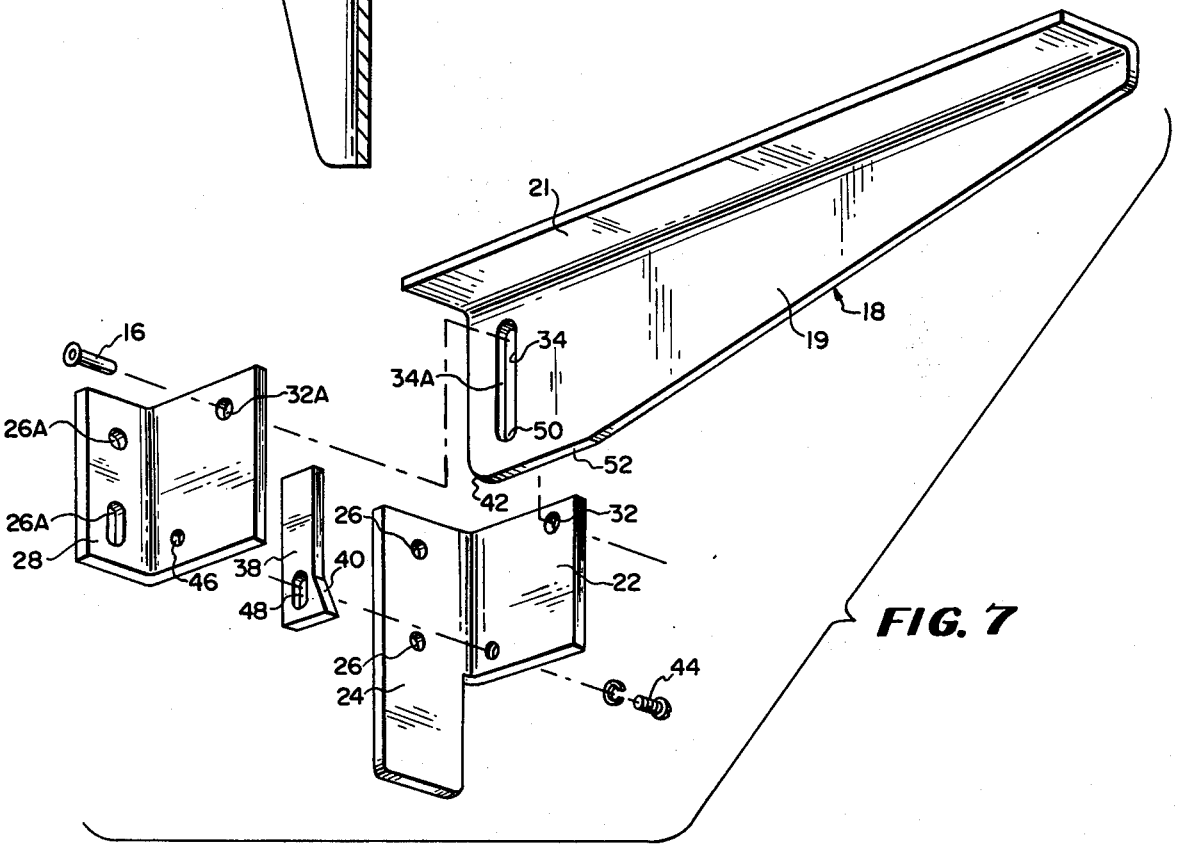
FIG. 7

FOLDING TRAY RAIL BRACKET

BACKGROUND OF THE INVENTION

In restaurants and stores where customers move a tray or basket along a horizontal rail or a cutting board for food or a display shelf is used which desirably should be folded down when not in use, and, where rigidity heretofore has presented problems, the rails have been rigidly supported to avoid personal injuries, spilling, or damage to either the rail, cleaning equipment or floors. Interference with customer's floor space or the look of emptiness when not in use provides objections and in some instances nuisances with playful children and uncomfortable seats generally damaged by people sitting on them.

SUMMARY OF THE INVENTION

A primary object is to prevent inadvertant collapse of a tray slide rail under accidental conditions experienced in the normal use of a folding rail. Only an unusual and intentional full lifting of the back, wall-supported edge of the rail will release the front edge for lowering it to a vertical orientation against the wall, and, when lowered, the cooperating elements are coextensive at their upper limits for appearance sake, and the tray rail when dropped below horizontal serves as a rail along the wall to provide floor clearance and for guiding and guarding against objects which might otherwise mar or damage a wall surface by impact contact therewith.

The rail is restored to its horizontal working position merely by moving the free depending edge outwardly and upwardly to any point above horizontal and then lowering it to its level horizontal working position. There is no critical front edge lift height if raised above horizontal thereby enabling easy handling by inexperienced personnel. Briefly, the rear edge must by lifted to drop the front edge, but the lowered front edge is lifted to restore the rail to its horizontal working position, yet if necessary, the front edge preferably can be raised all the way to a vertical height and held manually to provide temporary clearance for a horizontally moving object. When released the raised slide rail is returned automatically to its horizontal position by gravity.

A further object and advantage is that intentional lowering of the shelf by lifting the edge adjacent to the wall is unnatural and it is unlikely that customers would be likely to do this, yet the restoration of the shelf is simple merely by a natural lifting of the front edge with the effective weight of the lifting movement greatly minimized and accuracy and correctness of handling is maximized in one simple guided motion. Even the entire shelf can be lifted bodily by strangers or only the front edge without interfering with the ultimate lowering once the rear side is raised.

A further object is the provision of parts which provide maximum protection against damage if abused, and the operation of the working parts is preferably concealed from any curious observations involving malicious mischief.

Furthermore, the levelness of the slide rail in its operating position can be easily adjusted for wear or strain and for walls and rails that may be out of plumb.

These being among the objects and advantages of the invention, other and further objects will become apparent from the following description and the drawings in which:

IN THE DRAWINGS

FIG. 1 is a perspective view from below the level of the shelf disclosing the structure and relation of the supporting elements.

FIGS. 2 and 3 are sectional views taken on the lines 2 and 3 respectively in FIG. 1.

FIG. 5 illustrates the bracket in its lowered and vertical orientation.

FIG. 6 is an enlarged side elevation illustrating the levelling adjustment of the bracket, and FIG. 7 is an exploded view illustrating the parts and assembly of the rail bracket.

DESCRIPTION OF THE INVENTION

Figure 1:
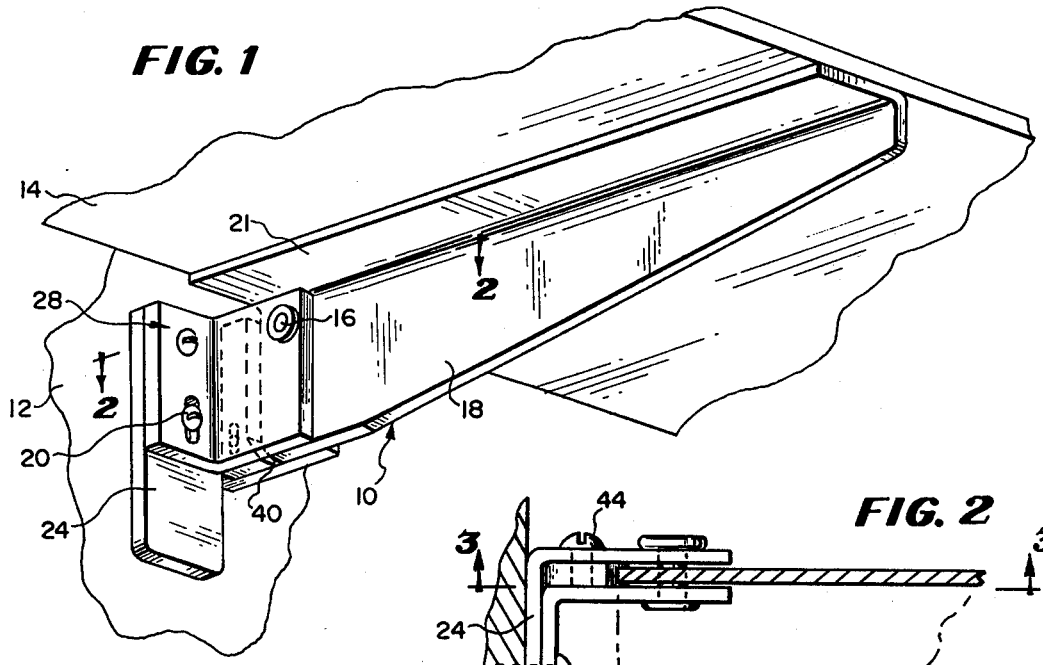
Figure 2:
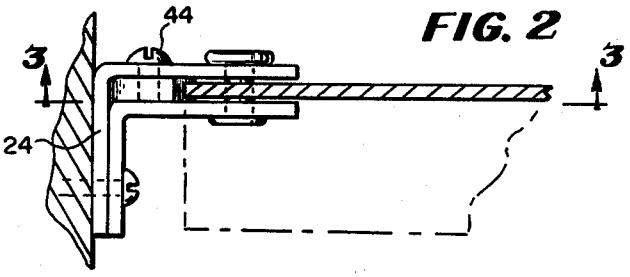
Figure 3:
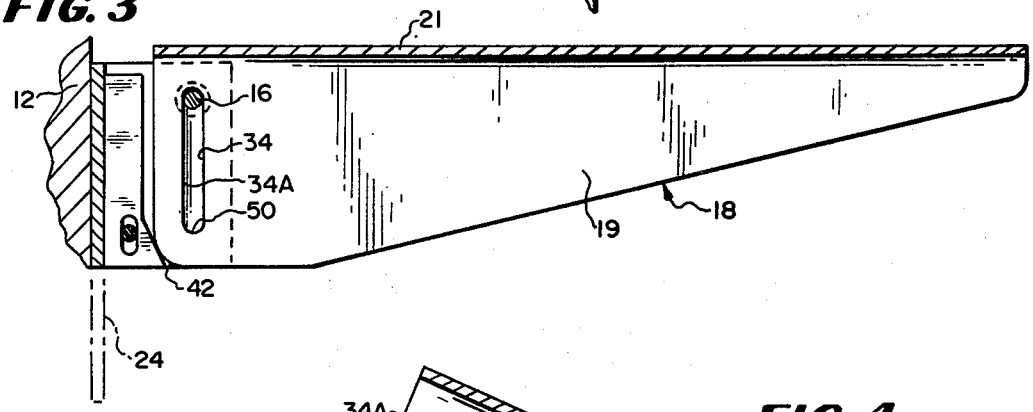
Figure 4:
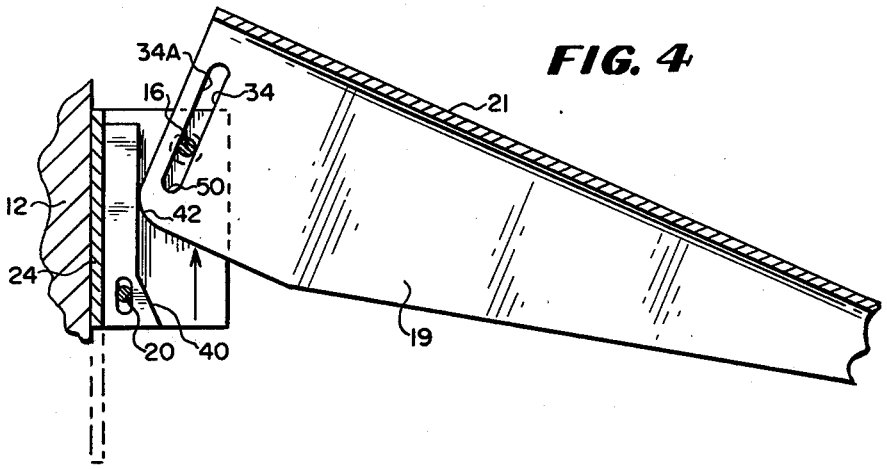
FIG. 4 illustrates an intermeditate position of the shelve support during the lowering operation.

In the drawings, like numbers refer to like parts and the entire bracket assembly 10 is shown mounted in place on a wall 12 with a tray supporting slide member 14 on the top thereof. The assembly is pivotally supported on horizontally aligned bolts, or preferably rivets 16 for permanency, that are rigidly carried on a bracket 18 which in turn is secured to a wall 12 or other vertical support by screws 20 generally at a level approximately waist high.

The bracket units 18 include an esthetically formed member to provide a vertical flange 19 supporting a flat top flange 21 that in turn supports the tray slide member 14 thereon. The member 14 may rest loosely thereon, if desired, but preferably is secured to the top flange 21 with conventional securements such as screws or rivets (not illustrated) for movement and handling as a unit therewith.

The bracket unit 18 as indicated in FIG. 7 is an assembly of an outer member 22 and a nesting inner member 28 preferably integrated by the welding of two L-shaped base elements, the outer one 22 of which has a vertically elongated base 24 that braces the wall 12 for weight support and is apertured at 26 to receive screws for that purpose. The inner element 28 is correspondingly apertured at 26A with the lower one elongated to assure free insertion of the wall screws 20. The inner member 28 is apertured at 32A in alignment with the aperture 32 to receive the weld rivet 16 through the vertically elongated slot 34 in the vertical flange 19, the inner edge of the slot 34 serving as a track 34A along which the weld rivet slides when the wall edge of the tray slide member 14 is raised for lowering the bracket.

The flanges 22 and 28 are spaced a distance enough to receive between them an adjustable filler block 38 defining a cam 40 of low angle inclination that is engaged by the rounded corner 42 on the bracket flange 19 for adjusting their contact point in levelling the bracket 18. The cam is vertically adjustable as clamped in proper position by the clamp screw 44 threaded into the opening 46, the elongated slot 48 in the cam block accommodating the adjustment.

When the lower end 50 of the slot 34 is raised high enough to engage the rivet 16, the rounded corner 42 will clear the block 38, as illustrated in FIG. 5, and the slide member 14 is lowered to a vertical position to serve as a wall guard side rail. A spacer contour 52 on the bottom edge of the vertical flange 19 squarely engages the base 24 for vertical support to hold the bracket away from contact with the wall.

Esthetically, for every installation the brackets preferably are made for right hand and left hand mountings to locate the bracket wall flanges symmetrically between the outermost brackets, two three or more being used on each slide member 14, depending on its convenient length.

The invention thus provides a substantially vertical slot near the rear of a vertical shelf support bracket having a vertical edge engaging a vertical wall in close proximinity thereto so that the shelf is thereby supported in horizontal position. The slot receives a pin and extends to within the same distance of the lower edge of the bracket so that the rear edge of the shelf must be intentionally lifted all the way and only then the front edge is free to drop to a vertical orientation by a 90° rotation about the pins 16.

Lifting the rear edge also assures a safety first step of clearing all objects off of the shelf because it is unnatural to lift the rear to lower the front and in doing so, such an action would would not be a matter of accidnet. Moreover, unthinkingly lifting the front edge of the shelf accidentally or otherwise does not outwardly spill objects from the shelf, and, being held by the incline of the shelf towards the walls are readily rightable without danger of lowering the shelf. The shelf however, rests flat against the wall when lowered.

On the other hand when restoring the shelf the movement to raise the front edge of the shelf is natural and when raised will permit the shelf to move and drop into a horizontally supported relation.

With maximum security separate motions are involved to lower the shelf or raise it. Lift the rear edge and let the front edge down; raise the front edge and the shelf drops into a secured level position.

What is claimed is:

1. A fold down tray rail comprising a tray supporting slide member, and a plurality of spaced brackets secured to the underside of the tray slide member, each bracket having a vertical flange defining a vertical track adjacent its inner end and facing its outer end, bracket support means mountable on a wall for each bracket and having a horizontally disposed pivot pin engaging said track for relative vertical movement, adjustable cam means carried by said bracket support means spaced from said pivot pin for engaging said bracket in cooperation with said pivot pin to adjust and determine in supporting relation the angle between the bracket and tray rail with respect to a weightbearing working position, cam means defining a vertically adjustable cam member to vary the relative horizontal orientation of said relieved lower end of said bracket with respect to said pin, and said bracket at its lower end engaging said cam means in its working position, and at its lower end being relieved to clear said cam means at the upper limit of bracket movement to free said bracket for downward hinging movement to a vertical depending position supported by said pin engaging said track.

2. The bracket support means defined in claim 1 comprising two spaced flanges maintaining each cam and the vertical flange of said bracket in guided engagement.

3. The bracket, pivot pin, track and cam means defined in claim 1 having horizontally and vertically spaced engagements to support the tray rail in relative vertical orientation.

* * * * *